US011228140B2

(12) United States Patent
Hsiao et al.

(10) Patent No.: US 11,228,140 B2
(45) Date of Patent: Jan. 18, 2022

(54) CABLE CONNECTOR AND ELECTRONIC DEVICE CONNECTION SYSTEM COMPRISING THE SAME

(71) Applicant: BIZLINK INTERNATIONAL CORPORATION, New Taipei (TW)

(72) Inventors: Hsin Tuan Hsiao, New Taipei (TW); Jui Hung Chien, New Taipei (TW)

(73) Assignee: Bizlink International Corporation, New Taipei (TW)

( * ) Notice: Subject to any disclaimer, the term of this patent is extended or adjusted under 35 U.S.C. 154(b) by 0 days.

(21) Appl. No.: 17/021,007

(22) Filed: Sep. 15, 2020

(65) Prior Publication Data

US 2021/0175663 A1 Jun. 10, 2021

(30) Foreign Application Priority Data

Dec. 5, 2019 (TW) ..... 108216227

(51) Int. Cl.

| | |
|---|---|
| ***H01R 13/627*** | (2006.01) |
| ***H01R 13/629*** | (2006.01) |
| ***H01R 13/502*** | (2006.01) |
| ***H01R 13/10*** | (2006.01) |
| ***H01R 12/53*** | (2011.01) |

(52) U.S. Cl.

CPC ..... *H01R 13/6275* (2013.01); *H01R 12/53* (2013.01); *H01R 13/10* (2013.01); *H01R 13/502* (2013.01); *H01R 13/629* (2013.01)

(58) Field of Classification Search

CPC ..... H01R 12/53; H01R 13/10; H01R 13/502; H01R 13/5202; H01R 13/6275; H01R 13/629; H02G 1/10; H02G 9/025

See application file for complete search history.

(56) References Cited

U.S. PATENT DOCUMENTS 8,439,706 B2 * 5/2013 Sytsma ..... H01R 13/658 439/607.46
8,454,381 B2 * 6/2013 Wu ..... H01R 13/506 439/352
8,475,199 B2 * 7/2013 Wang ..... H01R 13/6275 439/353

(Continued)

FOREIGN PATENT DOCUMENTS

CN 205429310 U 8/2016
CN 207038837 U 2/2018
TW M579831 U * 6/2019 ..... H01R 13/40

*Primary Examiner* — Abdullah A Riyami
*Assistant Examiner* — Nader J Alhawamdeh
(74) *Attorney, Agent, or Firm* — Rosenberg, Klein & Lee

(57) ABSTRACT

An electronic device connection system has a cable, a cable connector, and an electronic device. The electronic device has a socket. When the cable connector is mounted through the socket, the cable is electrically connected to the electronic device. The cable connector has a casing, a resilient latch, and a pulling member. The casing forms a protrusion and a first engaged opening. The resilient latch forms a hooked opening and a first hook. The protrusion can be engaged in the hooked opening, and the first hook can be engaged in the first engaged opening so the resilient latch is firmly fixed on the casing. Thus, the resilient latch may not be separated from the casing when a user pulls the pulling member, which ensures that the casing will be detached from the socket when the pulling member is pulled.

10 Claims, 10 Drawing Sheets

(56) References Cited

U.S. PATENT DOCUMENTS

| | | | | |
|---|---|---|---|---|
| 8,905,777 | B2 * | 12/2014 | Zhu | H01R 13/62 439/352 |
| 9,728,871 | B1 * | 8/2017 | Gutgold | H01R 13/6275 |
| 10,084,271 | B2 * | 9/2018 | Xing | H01R 12/59 |
| 10,096,944 | B2 * | 10/2018 | Huang | H01R 13/6582 |
| 10,236,605 | B1 * | 3/2019 | Henry | H01R 12/732 |
| 10,461,473 | B1 * | 10/2019 | Hsiao | H01R 13/639 |
| 10,535,939 | B1 * | 1/2020 | Qiao | H01R 13/504 |
| 10,868,387 | B2 * | 12/2020 | Hsiao | H01R 12/62 |
| 10,879,634 | B1 * | 12/2020 | Liao | H01R 12/77 |
| 11,075,476 | B2 * | 7/2021 | Hsiao | H01R 13/504 |
| 2010/0273335 | A1 * | 10/2010 | Wu | H01R 12/79 439/80 |
| 2020/0321727 | A1 * | 10/2020 | Li | H01R 13/6335 |
| 2020/0366016 | A1 * | 11/2020 | Hsiao | H01R 12/724 |
| 2020/0366025 | A1 * | 11/2020 | Hsiao | H01R 43/205 |
| 2021/0075159 | A1 * | 3/2021 | Wang | H01R 13/631 |
| 2021/0135402 | A1 * | 5/2021 | Li | H01R 13/6335 |
| 2021/0175650 | A1 * | 6/2021 | Hsiao | H01R 12/62 |
| 2021/0175663 | A1 * | 6/2021 | Hsiao | H01R 13/629 |
| 2021/0265782 | A1 * | 8/2021 | Wang | H01R 13/502 |

* cited by examiner

CABLE CONNECTOR AND ELECTRONIC DEVICE CONNECTION SYSTEM COMPRISING THE SAME

BACKGROUND OF THE INVENTION

1. Field of the Invention

The present invention relates to a component and a system for transmitting signals, especially to a connector mounted on a cable and an electronic device connection system including said connector.

2. Description of the Prior Arts

With ever-increasing efficacy of an electronic component and capacity of a storage component, volumes of the electronic components or the storage components become larger and thus a space in a device becomes insufficient. Therefore, volumes of the cables and other components connected to the cables should be reduced for disposing the electronic components or the storage components.

One of the conventional cable connectors comprises a controllable engagement structure which can engage a component when the cable connector is connected to said component. Then, when the engagement structure is pushed, the engagement structure may be separated from said component, and thereby the connector can be detached from said component. However, currently, the cable connector does not comprise the controllable engagement structure, but comprises a detachment structure which has a resilient latch and a pulling member. The resilient latch is configured to engage another component. The pulling member is connected to the resilient latch so that when the user pulls the pulling member, the resilient latch can be separated from the connected component and drive the connector to detach from said component at the same time.

However, a transmitting capacity of the cable also needs to be increased corresponding to the efficacy of the electronic component and the capacity of a storage component, and a common means is to increase an amount of pins of the cable. Because the pins of the cable connector have to contact pins of the electronic component or the storage component, more pins generate larger resistance. On the other hand, when detaching the cable from the electronic component or the storage component, a user has to exert larger force. Nevertheless, the resilient latch of the current cable connector cannot withstand such a larger force, so the resilient latch may be detached from the cable connector before the cable connector is detached from the electronic component or the storage component.

To overcome the shortcomings, the present invention provides a cable connector and an electronic device connection system comprising the same to mitigate or obviate the aforementioned problems.

SUMMARY OF THE INVENTION

The main objective of the present invention is to provide an electronic device connection system with a cable connector that can endure larger pulling force.

The electronic device connection system has a cable, a cable connector, and an electronic device. The cable connector is securely mounted on a first end of the cable. The electronic device has a socket. The cable connector is detachably mounted through the socket. The cable and the electronic device are electrically connected to each other when the cable connector is mounted through the socket.

The cable connector provided by the present invention defines an insertion direction, is sleeved on the aforesaid cable, and has a casing, a resilient latch, and a pulling member. The casing is sleeved on the first end of the cable and has an outer wall, at least one protrusion, and at least one first engaged opening. The at least one protrusion and at least one first engaged opening are formed on the outer wall of the casing. The resilient latch is securely mounted on the casing and has a first sheet, a second sheet, and a connection portion. The first sheet is securely mounted on the casing and has at least one hooked opening and at least one first hook. The at least one hooked opening is configured to be disposed around and engaged with the at least one protrusion. The at least one first hook is configured to be received and engaged in the at least one first engaged opening. The second sheet is spaced apart from the first sheet and has a detachment structure. The connection portion elastically and bendably connects the first sheet and the second sheet. The pulling member is connected to the detachment structure and has a connecting belt and a pull-loop. The connecting belt has a first end and a second end opposite each other. The first end of the connecting belt connected to the second sheet. The pull-loop is securely mounted on the second end of the connecting belt.

With the engagement between the protrusion of the casing and the hooked opening of the resilient latch and the engagement between the first engaged opening of the casing and the first hook of the resilient latch, the resilient latch can be durably fixed on the casing. Thus, even when the cable connector is tightly clamped by the socket, the user still can drive the resilient latch and the casing by pulling the pulling member, and thereby detach the casing from the socket. In other words, as long as the resilient latch is firmly mounted on the casing, the resilient latch may not be separated from the casing when the user pulls the pulling member, which ensures that the casing will be detached from the socket when the pulling member is pulled.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
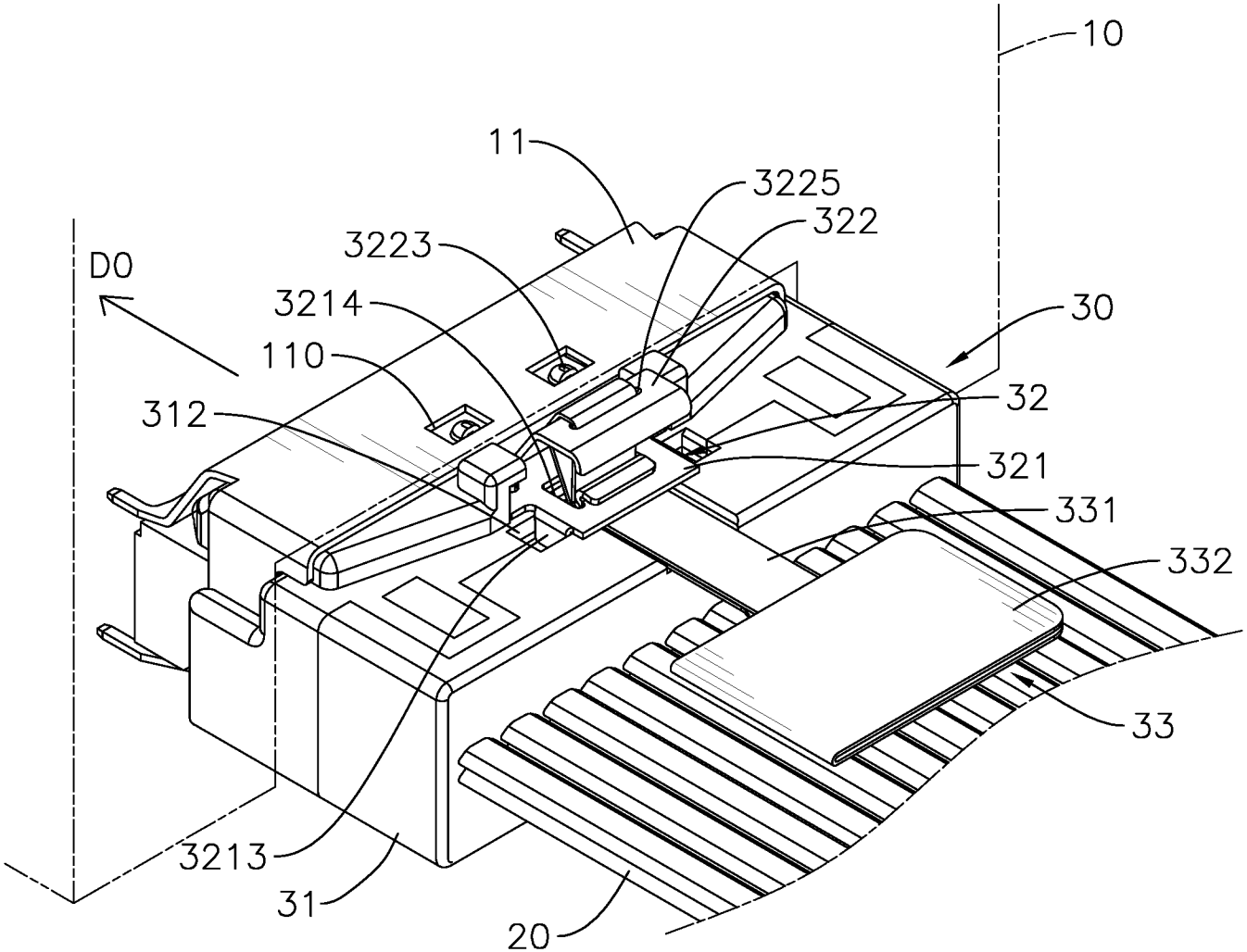
FIG. 1 is a perspective view of an electronic device connection system in accordance with the present invention.
Figure 2:
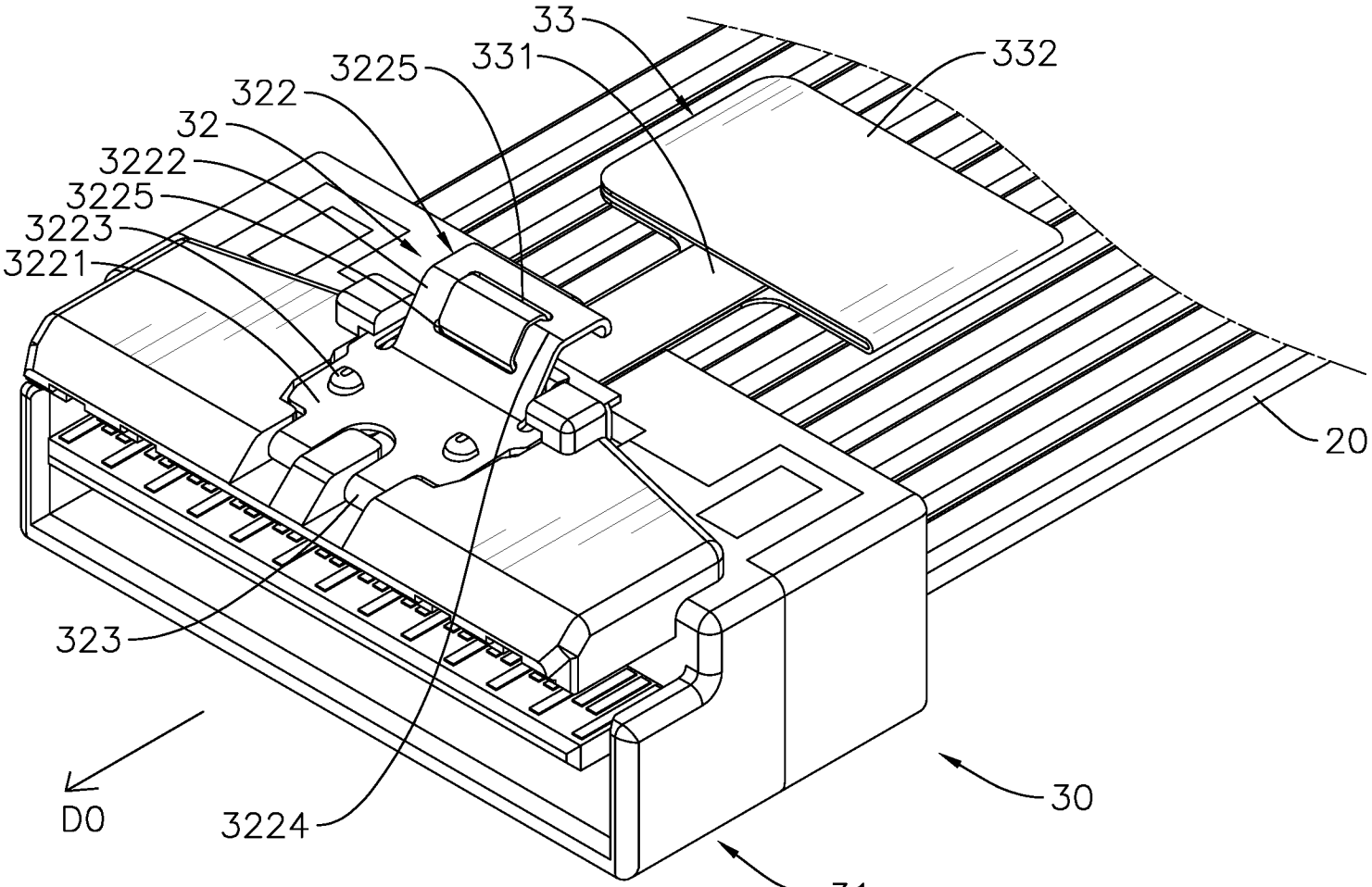
FIG. 2 is a perspective view of a cable connector and a cable of the electronic device connection system in FIG. 1.

With reference to FIG. 1, an electronic device connection system in accordance with the present invention is provided and comprises an electronic device 10, a cable 20, and a cable connector 30. The cable 20 includes a first end and a second end. The cable connector 30 is securely mounted on the first end of the cable 20 and thereby the cable 20 is mounted through the cable connector 30. The second end of the cable 20 is connected to a circuit board or another electronic device. The electronic device 10 comprises a socket 11 and the cable connector 30 is detachably mounted into the socket 11 and thereby the electronic device 10 is electrically connected to the cable 20. A movement direction in which the cable connector 30 is inserted into the socket 11 is defined as an insertion direction D0.

Then please refer to FIG. 2 to FIG. 5. The cable connector 30 comprises a casing 31, a resilient latch 32, and a pulling member 33. The casing 31 is sleeved on the first end of cable 20 and comprises an outer wall 310, at least one protrusion 311, and at least one first engaged opening 312. Both of the at least one protrusion 311 and the at least one first engaged opening 312 are formed on the outer wall 310. In the insertion direction D0, the at least one protrusion 311 is located in front of the at least one first engaged opening 312. The resilient latch 32 is securely mounted on the casing 31 by the at least one protrusion 311 and the at least one first engaged opening 312. The resilient latch 32 comprises a first sheet 321, a second sheet 322, and a connection portion 323. The first sheet 321 is securely mounted on the casing 31. Precisely, the first sheet 321 comprises a first sheet main body 3211, at least one hooked opening 3212, at least one first hook 3213, and a through hole 3214. The at least one hooked opening 3212 is formed on the first sheet main body 3211. The at least one first hook 3213 extends from the first sheet main body 3211. The at least one protrusion 311 of the casing 31 is configured to be received and engaged in the at least one hooked opening 3212; the at least one first hook 3213 is configured to be received and engaged in the at least one first engaged opening 312.

Figure 6:
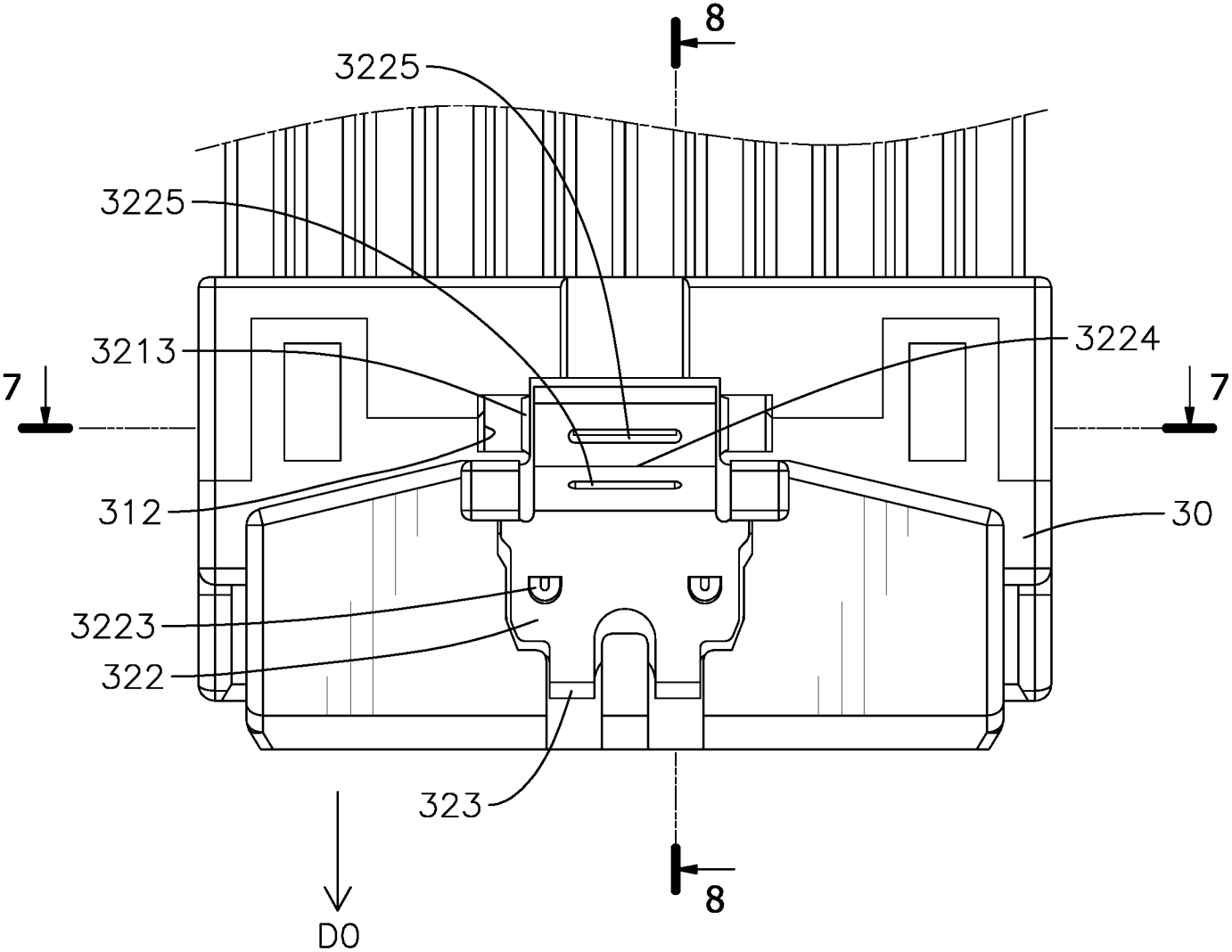
FIG. 6 is a top view of the cable connector in FIG. 1.
Figure 7:
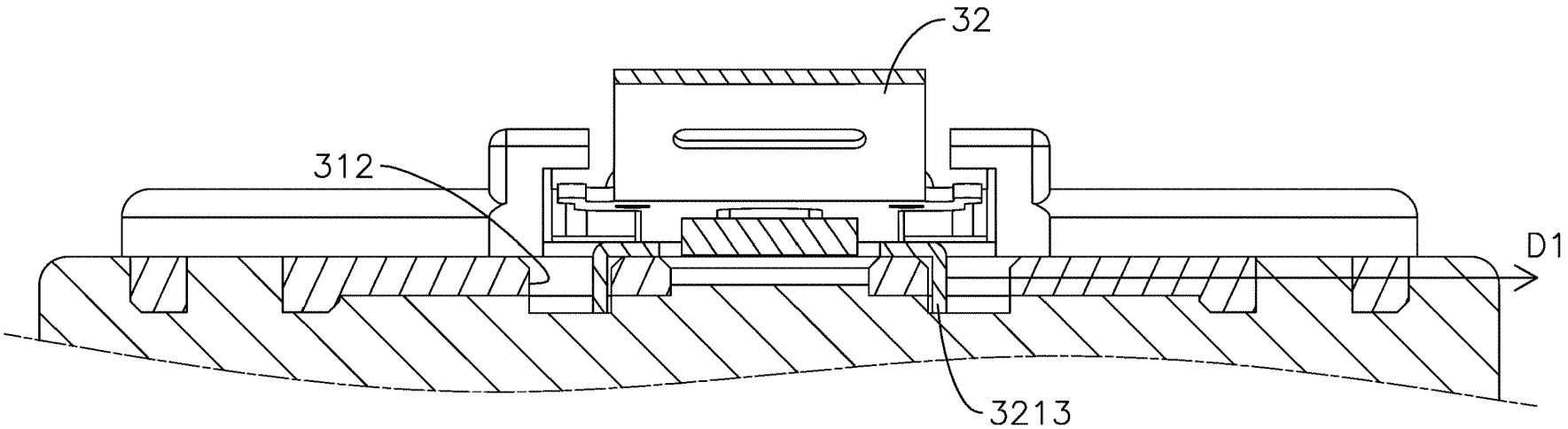
FIG. 7 is a sectional view of the cable connector across line 7-7 in FIG. 6.

Then please refer to FIG. 6 and FIG. 7 together. In this embodiment, the resilient latch 32 is securely mounted on the outer wall 310 of the casing 31, and the first sheet main body 3211 and the at least one first hook 3213 are mounted on the same surface. The first sheet main body 3211 and the at least one first hook 3213 may be a sheet formed integrally. During mounting of the resilient latch 32 on the casing 31, the at least one hooked opening 3212 of the first resilient latch 32 is disposed around the at least one protrusion 311 of the casing 31 first, and then the at least one first hook 3213 of the first resilient latch 32 is aligned with the at least one first engaged opening 312 of the casing 31, and then the at least one first hook 3213 is bent into the at least one first engaged opening 312. Thus, the at least one first hook 3213 engages the at least one first engaged opening 312.

Precisely, the at least one first hook 3213 is bent at a line, parallel with the insertion direction D0, on the first sheet main body 3211 so that the at least one first hook 3213 is moved into the at least one first engaged opening 312. In this embodiment, each first hook 3213 is a plate and a normal direction of the plate is defined as a first direction D1. The first direction D1 is perpendicular to the insertion direction D0 of the cable connector 30. In other words, the plate extends in the insertion direction D0 so the at least one first hook 3213 can sustain more force in the insertion direction D0.

Figure 8:
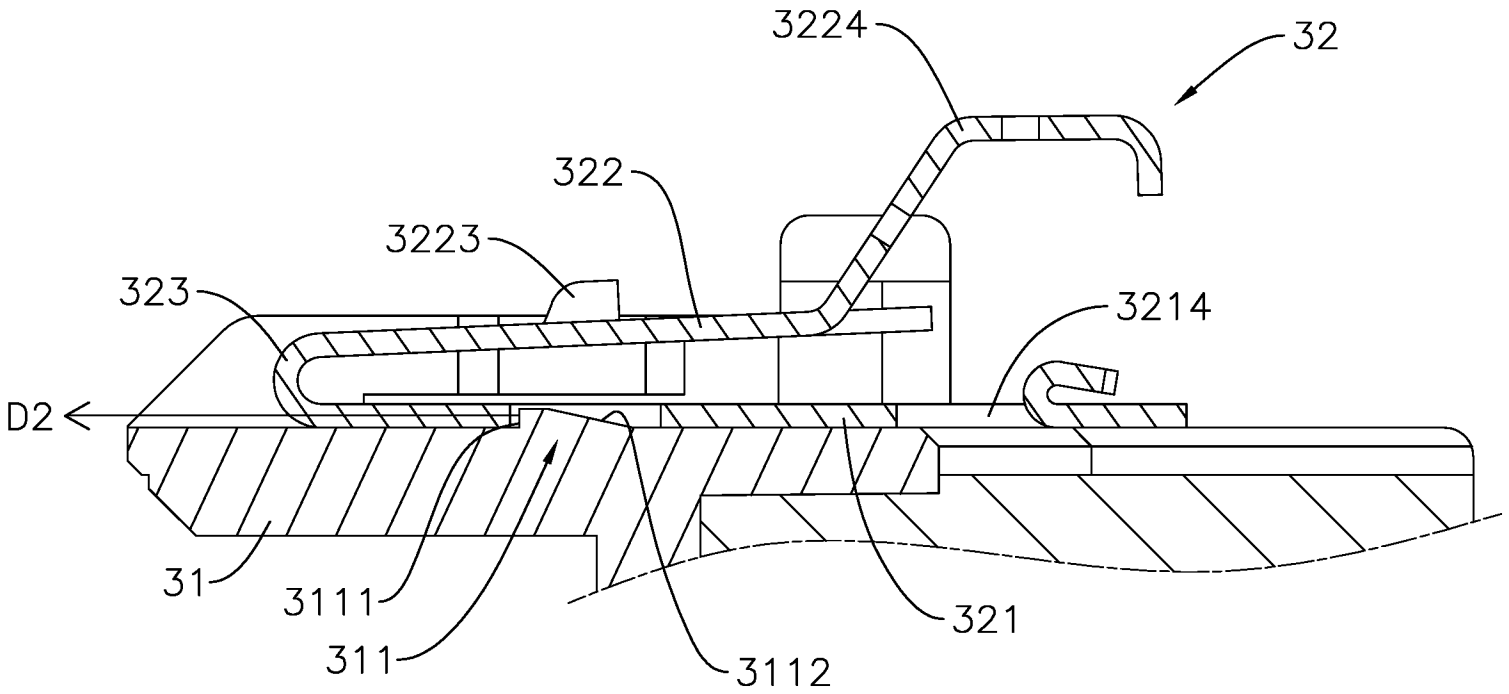
FIG. 8 is a sectional view of the cable connector across line 8-8 in FIG. 6.

Then please also refer to FIG. 6 and FIG. 8 Similarly, each one of the at least one protrusion 311 of the casing 31 forms multiple surfaces, and one of said surfaces is an engaging surface 3111 and another one is a guiding surface 3112. The engaging surface 3111 is away from the pulling member 33 and the guiding surface 3112 is close to the pulling member 33. A normal direction of the engaging surface 3111 is defined as a second direction D2. The second direction D2 is parallel with the insertion direction D0 of the cable connector 30. After the resilient latch 32 is fixed on the casing 31, the at least one protrusion 311 of the casing 31 is received in the at least one hooked opening 3212 of the resilient latch 32 and the engaging surface 3111 abuts an inner edge of each hooked opening 3212, and thereby the resilient latch 32 may not detach from the protrusion 311 when subjected to a force opposite the insertion direction D0. The guiding surface 3112 is inclined with respect to the insertion direction D0 of the cable connector 30, which facilitates the resilient latch 32 to be mounted on the casing 31.

Figure 3:
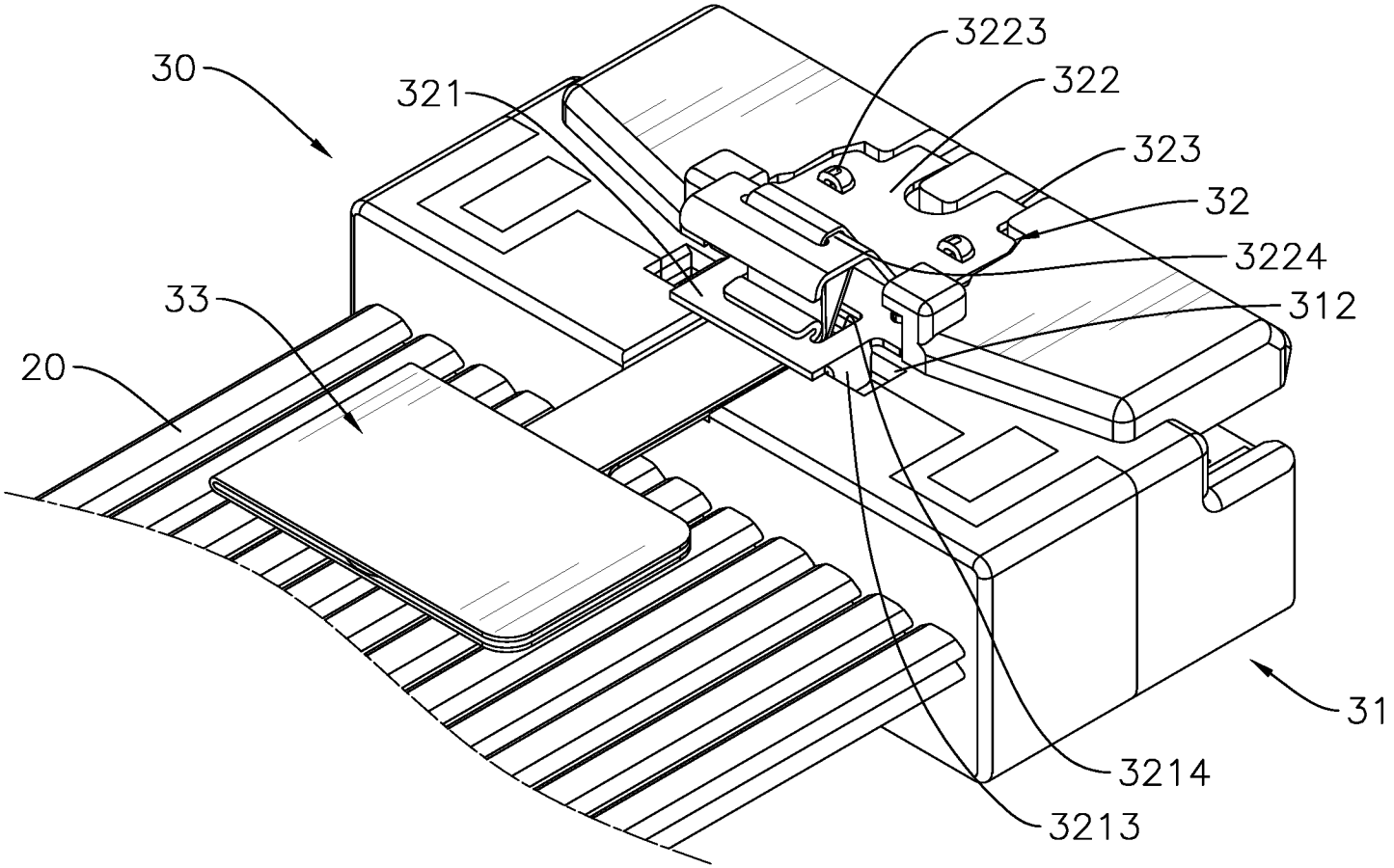
FIG. 3 is another perspective view of the cable connector and the cable in FIG. 1.
Figure 4:
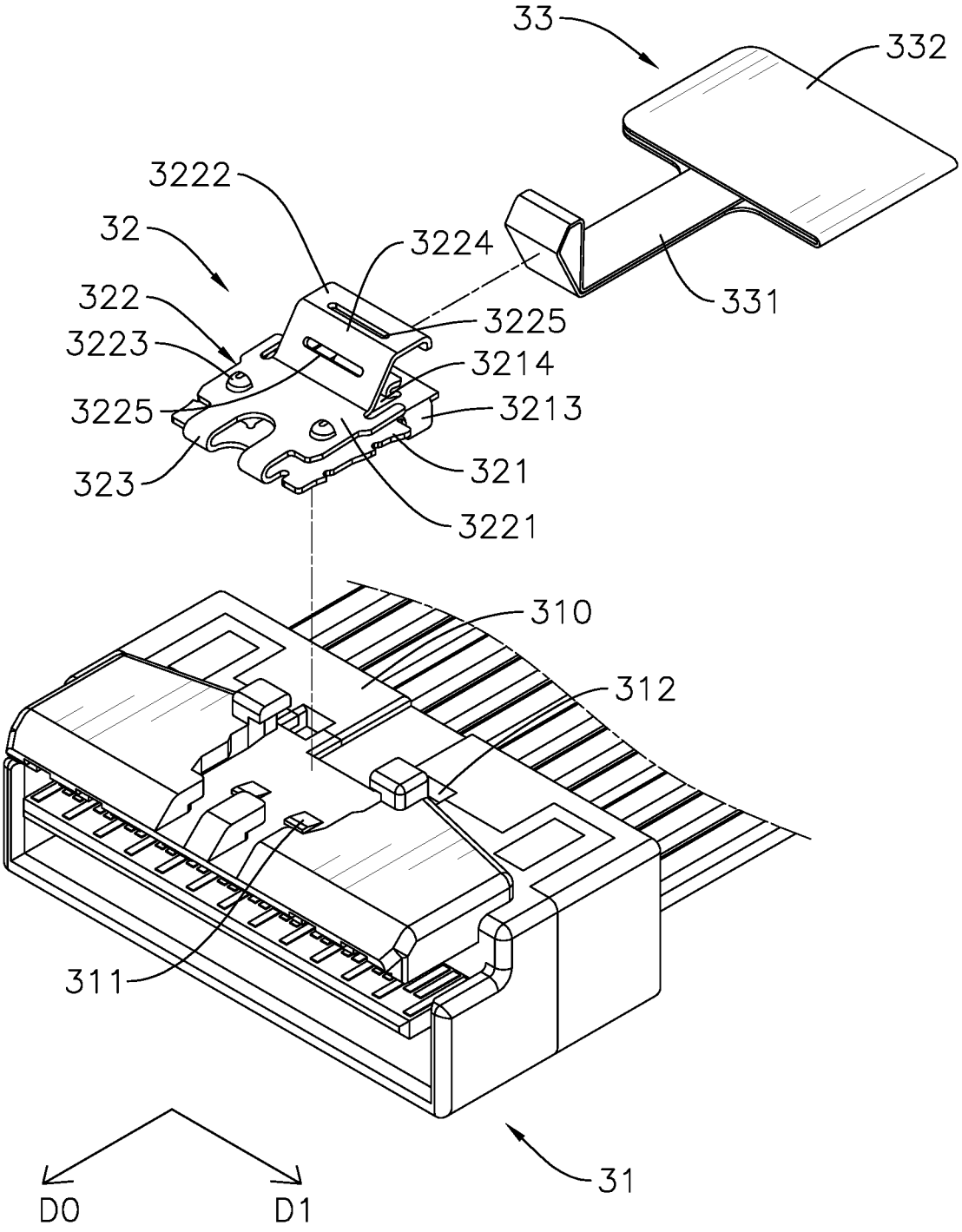
FIG. 4 is an exploded view of the cable connector in FIG. 1.
Figure 5:
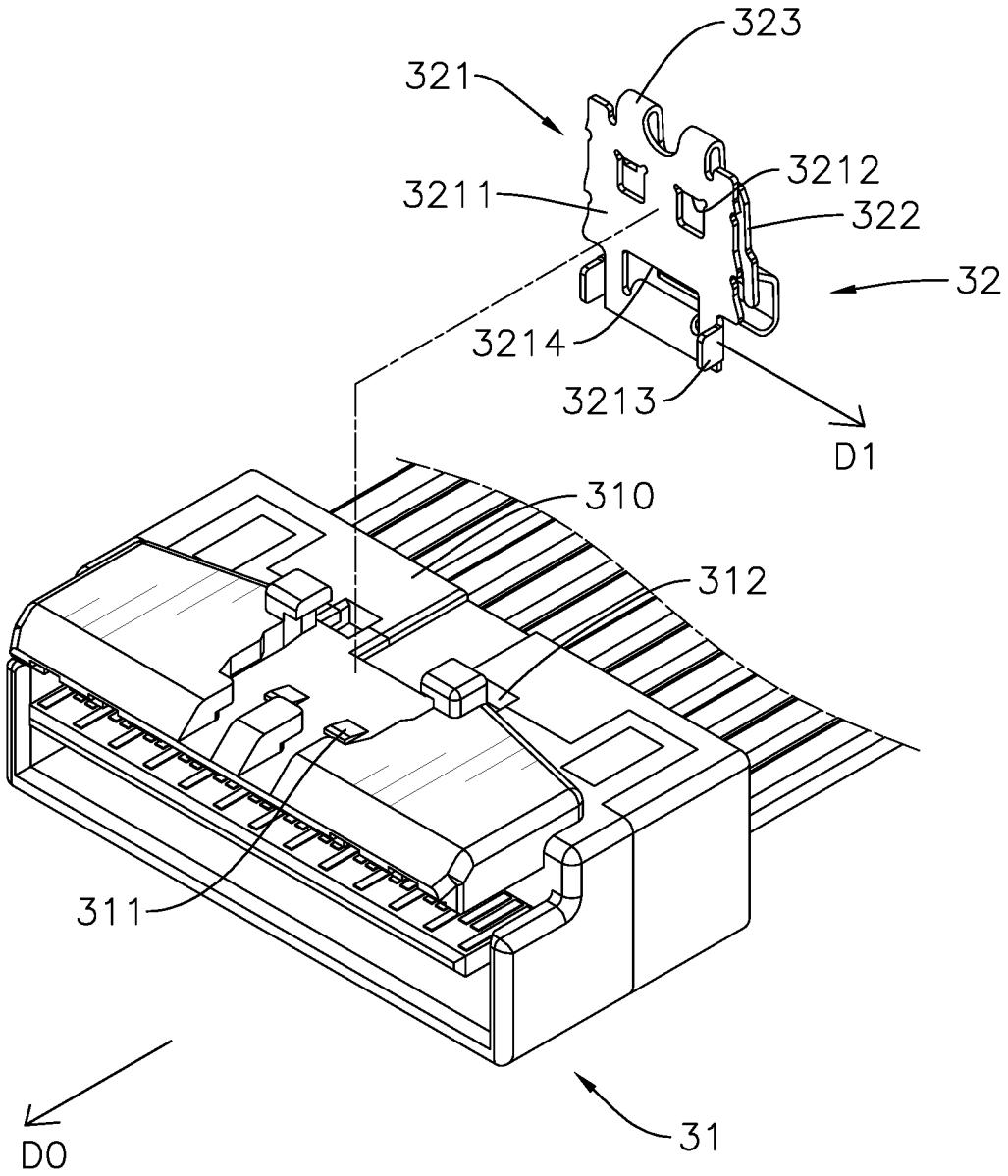
FIG. 5 is another exploded view of the cable connector in FIG. 1.

Then please refer to FIG. 3 and FIG. 4. The second sheet 322 and the first sheet 321 are spaced apart from each other and connected to each other via the first sheet 321. In other words, the connection portion 323 connects the first sheet 321 and the second sheet 322. The connection portion 323 is elastic and bendable, so when the resilient latch 32 is subjected to an external force, an angle between the second sheet 322 and the first sheet 321 may be changed. The second sheet 322 comprises a main body piece 3221, an operation piece 3222, and at least one second hook 3223. The main body piece 3221 is connected to the connection portion 323 and spaced apart from the first sheet 321. The operation piece 3222 comprises two ends opposite each other. One of the ends of the operation piece 3222 is securely mounted on the main body piece 3221. The other end of the operation piece 3222 obliquely extends away from the first sheet 321. The at least one second hook 3223 is securely mounted on the main body piece 3221 and extends away from the first sheet 321.

Figure 9:
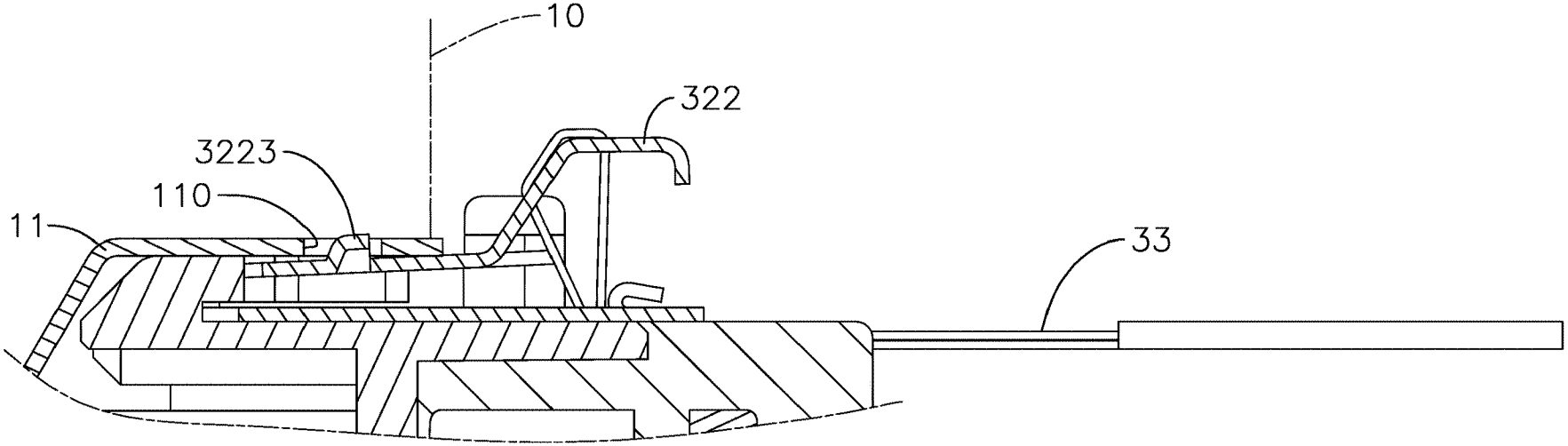
FIG. 9 and FIG. 10 are serial operational views of the electronic device connection system showing the cable connector detached from an electronic device of the electronic device connection system.
Figure 10:
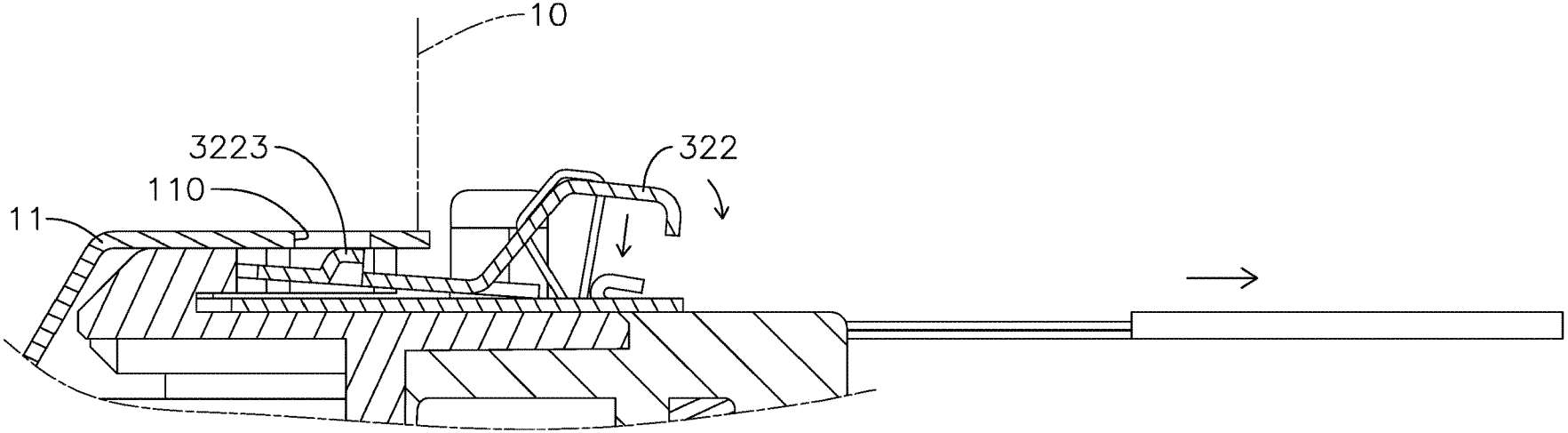

Then please also refer to FIG. 9 and FIG. 10. The operation piece 3222 may be a detachment structure of the second sheet 322 and the pulling member 33 is connected to the detachment structure. In this embodiment, the pulling member 33 comprises a connecting belt 331 and a pull-loop 332; the operation piece 3222 comprises a beam portion 3224. The connecting belt 331 comprises a first end and a second end opposite each other. The first end of the connecting belt 331 is connected to the operation piece 3222 of the second sheet 322 and the pull-loop 332 is securely mounted on the second end of the connecting belt 331. In this embodiment, the operation piece 3222 forms two traverse holes 3225 and the beam portion 3224 is located between the two traverse holes 3225. The connecting belt 331 of the pulling member 33 is sequentially mounted through the two traverse holes 3225 and thereby is wound on the beam portion 3224. In other words, the connecting belt 331 is connected to the operation piece 3222 so when a user pulls the pulling member 33, a moment may be exerted on the resilient latch 32 to tilt the second sheet 322.

In a preferred embodiment, the connecting belt 331 of the pulling member 33 passes through the through hole 3214 of the first sheet 321 from a surface, away from the second sheet 322, of the first sheet 321 and then is wound on the beam portion 3224 of the operation piece 3222, so that the first end of the connecting belt 331 is connected to the second sheet 322. Therefore, the connecting belt 331 extends from the first sheet 321 to the second sheet 322, and thereby when the user pulls the pulling member 33, the pulling member 33 may drive the second sheet 322 to move toward the first sheet 321, which facilitates the second sheet 322 to be tilted.

The socket 11 comprises at least one second engaged opening 110. When the cable connector 30 is mounted on the socket 11, the second hook 3223 of the cable connector 30 is received and engaged in the second engaged opening 110 of the socket 11. To separate the cable connector 30 from the socket 11, the user may just pull the pulling member 33 to tilt the second sheet 322 toward the first sheet 321, and thereby the at least one second hook 3223 of the second sheet 322 is detached from the at least one second engaged opening 110 of the socket 11. At the same time, the at least one hooked opening 3212 and the at least one first hook 3213 of the first sheet 321 are still respectively fixed on the at least one protrusion 311 and the at least one first engaged opening 312 of the casing 31, and thereby the resilient latch 32 can drive the casing 31 to detach from the socket 11. Besides, except for the engagement between the at least one hooked opening 3212 and the at least one protrusion 311, the present invention further includes the engagement between the at least one first hook 3213 and the at least one first engaged opening 312, so the resilient latch 32 may sustain larger pulling force.

Consequently, with the engagement between the at least one protrusion 311 and the at least one hooked opening 3212 and the engagement between the at least one first engaged opening 312 and the at least one first hook 3213, the resilient latch 32 can be durably fixed on the casing 31. Thus, even when the cable connector 30 is tightly clamped by the socket 11, the user still can drive the resilient latch 32 and the casing 31 by pulling the pulling member 33, and thereby detach the casing 31 from the socket 11. In other words, as long as the resilient latch 32 is firmly mounted on the casing 31, the latch 32 may not be separated from the casing 31 while the user is pulling the pulling member 33, which ensures that the casing 31 will be detached from the socket 11 when the pulling member 33 is pulled.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cable connector sleeved on a cable, and comprising:
- a casing sleeved on a first end of the cable and comprising:
  - an outer wall;
  - at least one protrusion formed on the outer wall of the casing; and
  - at least one first engaged opening formed on the outer wall of the casing;
- a resilient latch securely mounted on the casing and comprising:
  - a first sheet securely mounted on the casing and comprising:
    - at least one hooked opening configured to be disposed around and engaged with the at least one protrusion; and
    - at least one first hook configured to be received and engaged in the at least one first engaged opening;
  - a second sheet spaced apart from the first sheet and comprising:
    - a detachment structure; and
  - a connection portion elastically and bendably connecting the first sheet and the second sheet; and
- a pulling member connected to the detachment structure and comprising:
  - a connecting belt comprising a first end and a second end opposite each other, the first end of the connecting belt connected to the second sheet; and
  - a pull-loop securely mounted on the second end of the connecting belt.

2. The cable connector as claimed in claim 1, wherein each one of the at least one first hook of the resilient latch is a plate and defines:
- a first direction being a normal direction of the plate; wherein the first direction is perpendicular to an insertion direction of the cable connector.

3. The cable connector as claimed in claim 1, wherein each one of the at least one protrusion of the casing forms:
- an engaging surface being one surface, away from the pulling member, of the protrusion; the engaging surface configured to abut an inner edge of the hooked opening of the resilient latch and defining:
  - a second direction being a normal direction of the engaging surface; wherein the second direction is parallel with an insertion direction of the cable connector.

4. The cable connector as claimed in claim 1, wherein each one of the at least one protrusion of the casing forms:
- a guiding surface being one surface, close to the pulling member, of the protrusion; the guiding surface being inclined with respect to an insertion direction of the cable connector.

5. The cable connector as claimed in claim 1, wherein in an insertion direction of the cable connector, the at least one protrusion is located in front of the at least one first engaged opening.

6. The cable connector as claimed in claim 1, wherein the detachment structure of the second sheet comprises:
- a beam portion; the first end of the connecting belt wound on the beam portion.

7. The cable connector as claimed in claim 1, wherein:
- the second sheet comprises:
  - a main body piece connected to the connection portion and spaced apart from the first sheet; and
- the detachment structure includes:
  - an operation piece; one end of the operation piece securely mounted on the main body piece and another end of the operation piece obliquely extending away from the first sheet; the first end of the connecting belt connected to the operation piece.

8. The cable connector as claimed in claim 1, wherein the first sheet comprises:
- a through hole; the connecting belt passing through the through hole from a surface, away from the second sheet, of the first sheet and then the first end of the connecting belt connected to the second sheet.

9. An electronic device connection system comprising:
- a cable;
- the cable connector as claimed in claim 1 securely mounted on an end of the cable; and
- an electronic device comprising:
  - a socket, the cable connector detachably mounted through the socket; the cable and the electronic device electrically connected to each other when the cable connector is mounted through the socket.

10. The electronic device connection system as claimed in claim 9, wherein:

the socket comprises:

at least one second engaged opening; and the second sheet of the cable connector further comprises:

at least one second hook extending away from the first sheet;

the at least one second hook configured to be received and engaged in the at least one second engaged opening.

* * * * *